US010026418B2

(12) United States Patent
Xiao

(10) Patent No.: US 10,026,418 B2
(45) Date of Patent: Jul. 17, 2018

(54) ABNORMAL FRAME DETECTION METHOD AND APPARATUS

(71) Applicant: Huawei Technologies Co., Ltd., Shenzhen (CN)

(72) Inventor: Wei Xiao, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 39 days.

(21) Appl. No.: 15/415,335

(22) Filed: Jan. 25, 2017

(65) Prior Publication Data

US 2017/0133040 A1 May 11, 2017

Related U.S. Application Data

(63) Continuation of application No. PCT/CN2015/071640, filed on Jan. 27, 2015.

(30) Foreign Application Priority Data

Jul. 29, 2014 (CN) ..... 2014 1 0366454

(51) Int. Cl.
*G10L 19/00* (2013.01)
*G10L 25/60* (2013.01)
(Continued)

(52) U.S. Cl.
CPC ..... *G10L 25/60* (2013.01); *G10L 21/0205* (2013.01); *G10L 25/06* (2013.01); *G10L 25/21* (2013.01)

(58) Field of Classification Search
CPC .... G10L 19/005; G10L 19/025; G10L 21/028
See application file for complete search history.

(56) References Cited

U.S. PATENT DOCUMENTS 5,097,507 A * 3/1992 Zinser ..... G10L 19/005 704/226
5,341,457 A * 8/1994 Hall, II ..... H03M 7/42 381/1

(Continued)

FOREIGN PATENT DOCUMENTS

CN 1988708 A 6/2007
CN 102881289 A 1/2013

(Continued)

OTHER PUBLICATIONS

"Series P: Telephone Transmission Quality, Telephone Installations, Local Line Networks," International Telecommunication Union, ITU-T P.563, May 2004, 66 pages.

(Continued)

*Primary Examiner* — Daniel Abebe
(74) *Attorney, Agent, or Firm* — Slater Matsil, LLP

(57) ABSTRACT

An abnormal frame detection method and apparatus are disclosed. In an embodiment the method includes obtaining a signal frame from a speech signal, and dividing the signal frame into at least two subframes; obtaining a local energy value of a subframe of the signal frame; obtaining, according to the local energy value of the subframe, a first characteristic value used to indicate a local energy trend of the signal frame; performing singularity analysis on the signal frame to obtain a second characteristic value; and determining the signal frame as an abnormal frame if the first characteristic value meets a first threshold and the second characteristic value meets a second threshold. It is implemented whether distortion occurs in a speech signal is detected.

28 Claims, 5 Drawing Sheets

(51) Int. Cl.

| | |
|---|---|
| ***G10L 25/21*** | (2013.01) |
| ***G10L 25/06*** | (2013.01) |
| ***G10L 21/02*** | (2013.01) |

(56) References Cited

U.S. PATENT DOCUMENTS

| | | | | |
|---|---|---|---|---|
| 5,586,126 | A * | 12/1996 | Yoder | G10L 19/005 704/E19.003 |
| 6,233,708 | B1 | 5/2001 | Hindelang et al. | |
| 6,775,521 | B1 | 8/2004 | Chen | |
| 8,472,616 | B1 | 6/2013 | Jiang | |
| 2010/0138220 | A1 | 6/2010 | Matsumoto et al. | |
| 2015/0213798 | A1 | 7/2015 | Xiao | |
| 2015/0325256 | A1 | 11/2015 | Xu | |

FOREIGN PATENT DOCUMENTS

| | | | |
|---|---|---|---|
| CN | 103632682 | A | 3/2014 |
| CN | 103730131 | A | 4/2014 |
| CN | 103903633 | A | 7/2014 |
| WO | 0247068 | A2 | 6/2002 |

OTHER PUBLICATIONS

"Series P: Telephone Transmission Quality, Methods for objective and subjective assessment of quality," International Telecommunication Union, ITU-T, P.800, Aug. 1996, 37 pages.

Kim, et al., "ANIQUE +: A New American National Standard for Non-Intrusive Estimation of Narrowband Speech Quality," Bell Labs Technical Journal 12(1), 2007 [no date], 16 pages.

Malfait, et al., "P.563-The ITU-T Standard for Single-Ended Speech Quality Assessment," IEEE Transactions on Audio, Speech, and Language Processing, vol. 14, No. 6, Nov. 2006, 11 pages.

* cited by examiner

ABNORMAL FRAME DETECTION METHOD AND APPARATUS

CROSS-REFERENCE TO RELATED APPLICATIONS

This application is a continuation of International application Ser. No. PCT/CN2015/071640, filed on Jan. 27, 2015, which claims priority to Chinese Patent Application No. 201410366454.0, filed on Jul. 29, 2014. The disclosures of the aforementioned applications are hereby incorporated by reference in their entireties.

TECHNICAL FIELD

The present disclosure relates to speech processing technologies, and in particular, to an abnormal frame detection method and apparatus.

BACKGROUND

In the audio technology research field, an audio quality test is important. For example, in a wireless communications scenario, during transmission from a calling party to a called party, a sound needs to undergo various processing, such as analogy-to-digital (A/D) conversion, encoding, transmission, decoding, and digital-to-analog D/A conversion. In this process, quality of a received speech signal may deteriorate because of a factor such as a packet loss appearing during the encoding or transmission. A phenomenon of speech quality deterioration is referred to as speech distortion. Many methods for testing speech quality have been studied in the industry. For example, a manual subjective test method in which a test assessment result is given by organizing testers to listen to to-be-tested audio. However, the method has a long period and high costs. A method for automatically detecting in a timely manner whether speech distortion occurs needs to be obtained in the industry, so as to automatically test and assess the speech quality.

SUMMARY

Embodiments of the present disclosure provide an abnormal frame detection method and apparatus, so as to detect whether distortion occurs in a speech signal.

According to a first aspect, an abnormal frame detection method is provided, where the method includes: obtaining a signal frame from a speech signal; dividing the signal frame into at least two subframes; obtaining a local energy value of a subframe of the signal frame; obtaining, according to the local energy value of the subframe, a first characteristic value used to indicate a local energy trend of the signal frame; performing singularity analysis on the signal frame to obtain a second characteristic value used to indicate a singularity characteristic of the signal frame; and determining the signal frame as an abnormal frame if the first characteristic value of the signal frame meets a first threshold and the second characteristic value of the signal frame meets a second threshold.

With reference to the first aspect, in a first possible implementation manner, the obtaining, according to the local energy value of the subframe, a first characteristic value used to indicate a local energy trend of the signal frame includes: obtaining a maximum local energy value and a minimum local energy value that are in a logarithm domain and that are in local energy values of all the subframes in the signal frame; and performing subtraction on the maximum local energy value and the minimum local energy value that are in the logarithm domain to obtain a first difference value, where the first difference value is the first characteristic value.

With reference to the first aspect, in a second possible implementation manner, the obtaining, according to the local energy value of the subframe, a first characteristic value used to indicate a local energy trend of the signal frame includes: determining target correlated subframes in a correlated signal frame prior to the signal frame in a time domain, and calculating local energy values of the target correlated subframes to obtain a minimum local energy value that is in a logarithm domain and that is in the local energy values of the target correlated subframes; obtaining a maximum local energy value that is in the logarithm domain and that is in local energy values of all the subframes of the signal frame; and performing subtraction on the maximum local energy value and the minimum local energy value that are in the logarithm domain to obtain a second difference value, where the second difference value is the first characteristic value.

With reference to the first aspect, in a third possible implementation manner, the obtaining, according to the local energy value of the subframe, a first characteristic value used to indicate a local energy trend of the signal frame includes: obtaining a maximum local energy value and a minimum local energy value that are in a logarithm domain and that are in local energy values of all the subframes in the signal frame; determining target correlated subframes in a correlated signal frame prior to the signal frame in a time domain, and calculating local energy values of the target correlated subframes to obtain a minimum local energy value that is in the logarithm domain and that is in the local energy values of the target correlated subframes; performing subtraction on the maximum local energy value and the minimum local energy value that are in the logarithm domain and that are in the local energy values of all the subframes in the signal frame to obtain a first difference value; performing subtraction on the maximum local energy value that is in the logarithm domain and that is in the local energy values of all the subframes in the signal frame and the minimum local energy value that is in the logarithm domain and that is in the local energy values of the target correlated subframes to obtain a second difference value; and selecting, between the first difference value and the second difference value, a smaller value as the first characteristic value.

With reference to any one of the first aspect to the third possible implementation manner of the first aspect, in a fourth possible implementation manner, the performing singularity analysis on the signal frame to obtain a second characteristic value used to indicate a singularity characteristic includes: performing wavelet decomposition on the signal frame to obtain a wavelet coefficient, and performing signal reconstruction according to the wavelet coefficient to obtain a reconstructed signal frame; and obtaining the second characteristic value according to a maximum local energy value and an average local energy value that are in the logarithm domain and that are in local energy values of all subframes of the reconstructed signal frame.

With reference to the fourth possible implementation manner of the first aspect, in a fifth possible implementation manner, the obtaining the second characteristic value according to a maximum local energy value and an average local energy value that are in the logarithm domain and that are in local energy values of all subframes of the reconstructed signal frame includes: performing subtraction on the maximum local energy value and the average local energy value that are in the logarithm domain and that are in the local energy values of all the subframes of the reconstructed signal frame, where an obtained difference value is the second characteristic value.

With reference to any one of the first aspect to the fifth possible implementation manner of the first aspect, in a sixth possible implementation manner, if a spacing between the signal frame and a prior abnormal frame in the speech signal is less than a third threshold, after the determining the signal frame as an abnormal frame, the method further includes: adjusting a normal frame between the signal frame and the prior abnormal frame to an abnormal frame.

With reference to any one of the first aspect to the fifth possible implementation manner of the first aspect, in a seventh possible implementation manner, after a signal frame that is in the speech signal and that needs to undergo abnormal frame detection is detected, the method further includes: counting a quantity of abnormal frames in the speech signal, and if the quantity of abnormal frames is less than a fourth threshold, adjusting all abnormal frames in the speech signal to normal frames.

With reference to any one of the first aspect to the fifth possible implementation manner of the first aspect, in an eighth possible implementation manner, after a signal frame that is in the speech signal and that needs to undergo abnormal frame detection is detected, the method further includes: calculating a percentage of the abnormal frame in the speech signal; and if the percentage of the abnormal frame is greater than a fifth threshold, outputting speech distortion alarm information.

With reference to any one of the first aspect to the eighth possible implementation manner of the first aspect, in a ninth possible implementation manner, after a signal frame that is in the speech signal and that needs to undergo abnormal frame detection is detected, the method further includes: calculating a first speech quality evaluation value of the speech signal according to a detection result of the signal frame that needs to undergo the abnormal frame detection, where the detection result indicates that any frame in the signal frame that needs to undergo the abnormal frame detection is a normal frame or an abnormal frame.

With reference to the ninth possible implementation manner of the first aspect, in a tenth possible implementation manner, the calculating a first speech quality evaluation value of the speech signal according to a detection result of the signal frame that needs to undergo the abnormal frame detection includes: obtaining the percentage of the abnormal frame in the speech signal; and obtaining, according to the percentage and a quality evaluation parameter, the first speech quality evaluation value corresponding to the percentage.

With reference to the ninth or the tenth possible implementation manner of the first aspect, in an eleventh possible implementation manner, after the calculating a first speech quality evaluation value of the speech signal, the method further includes: obtaining a second speech quality evaluation value of the speech signal by using a speech quality assessment method; and obtaining a third speech quality evaluation value according to the first speech quality evaluation value and the second speech quality evaluation value.

With reference to the eleventh possible implementation manner of the first aspect, in a twelfth possible implementation manner, the obtaining a third speech quality evaluation value according to the first speech quality evaluation value and the second speech quality evaluation value includes: subtracting the first speech quality evaluation value from the second speech quality evaluation value to obtain the third speech quality evaluation value.

With reference to any one of the first aspect to the eighth possible implementation manner of the first aspect, in a thirteenth possible implementation manner, after a signal frame that is in the speech signal and that needs to undergo abnormal frame detection is detected, the method further includes: obtaining an anomaly detection characteristic value of the speech signal according to a detection result of the signal frame that needs to undergo the abnormal frame detection; obtaining an assessment characteristic value of the speech signal by using a speech quality assessment method; and obtaining a fourth speech quality evaluation value according to the anomaly detection characteristic value and the assessment characteristic value by using an assessment system.

According to a second aspect, an abnormal frame detection apparatus is provided, where the apparatus includes: a signal division unit, configured to obtain a signal frame from a speech signal, and divide the signal frame into at least two subframes; a signal analysis unit, configured to obtain a local energy value of a subframe of the signal frame; obtain, according to the local energy value of the subframe, a first characteristic value used to indicate a local energy trend of the signal frame; and perform singularity analysis on the signal frame to obtain a second characteristic value used to indicate a singularity characteristic of the signal frame; and a determining unit, configured to determine the signal frame as an abnormal frame when the first characteristic value of the signal frame meets a first threshold and the second characteristic value of the signal frame meets a second threshold.

With reference to the second aspect, in a first possible implementation manner, when calculating the first characteristic value, the signal analysis unit is specifically configured to: obtain a maximum local energy value and a minimum local energy value that are in a logarithm domain and that are in local energy values of all the subframes in the signal frame; and perform subtraction on the maximum local energy value and the minimum local energy value that are in the logarithm domain to obtain a first difference value, where the first difference value is the first characteristic value.

With reference to the second aspect, in a second possible implementation manner, when calculating the first characteristic value, the signal analysis unit is specifically configured to: determine target correlated subframes in a correlated signal frame prior to the signal frame in a time domain, and calculate local energy values of the target correlated subframes to obtain a minimum local energy value that is in a logarithm domain and that is in the local energy values of the target correlated subframes; obtain a maximum local energy value that is in the logarithm domain and that is in local energy values of all the subframes of the signal frame; and perform subtraction on the maximum local energy value and the minimum local energy value that are in the logarithm domain to obtain a second difference value, where the second difference value is the first characteristic value.

With reference to the second aspect, in a third possible implementation manner, when calculating the first characteristic value, the signal analysis unit is specifically configured to: obtain a maximum local energy value and a minimum local energy value that are in a logarithm domain and that are in local energy values of all the subframes in the signal frame; determine target correlated subframes in a correlated signal frame prior to the signal frame in a time domain, and calculate local energy values of the target correlated subframes to obtain a minimum local energy value that is in the logarithm domain and that is in the local energy values of the target correlated subframes; perform subtraction on the maximum local energy value and the minimum local energy value that are in the logarithm domain and that are in the local energy values of all the subframes in the signal frame to obtain a first difference value; perform subtraction on the maximum local energy value that is in the logarithm domain and that is in the local energy values of all the subframes in the signal frame and the minimum local energy value that is in the logarithm domain and that is in the local energy values of the target correlated subframes to obtain a second difference value; and select, between the first difference value and the second difference value, a smaller value as the first characteristic value.

With reference to any one of the second aspect to the third possible implementation manner of the second aspect, in a fourth possible implementation manner, when calculating the second characteristic value, the signal analysis unit is specifically configured to: perform wavelet decomposition on the signal frame to obtain a wavelet coefficient, and obtain the second characteristic value according to a maximum local energy value and an average local energy value that are in the logarithm domain and that are in local energy values of all subframes of a reconstructed signal frame.

With reference to the fourth possible implementation manner of the second aspect, in a fifth possible implementation manner, when obtaining the second characteristic value according to the maximum local energy value and the average local energy value that are in the logarithm domain and that are in the local energy values of all the subframes of the reconstructed signal frame, the signal analysis unit is specifically configured to perform subtraction on the maximum local energy value and the average local energy value that are in the logarithm domain and that are in the local energy values of all the subframes of the reconstructed signal frame, where an obtained difference value is the second characteristic value.

With reference to any one of the second aspect to the fifth possible implementation manner of the second aspect, in a sixth possible implementation manner, the apparatus further includes a signal processing unit, configured to: when a spacing between the signal frame and a prior abnormal frame in the speech signal is less than a third threshold and if the signal frame is an abnormal frame, adjust a normal frame between the signal frame and the prior abnormal frame to an abnormal frame.

With reference to any one of the second aspect to the fifth possible implementation manner of the second aspect, in a seventh possible implementation manner, the apparatus further includes a signal processing unit, configured to count a quantity of abnormal frames in the speech signal, and if the quantity of abnormal frames is less than a fourth threshold, adjust all abnormal frames in the speech signal to normal frames.

With reference to any one of the second aspect to the fifth possible implementation manner of the second aspect, in an eighth possible implementation manner, the apparatus further includes a signal processing unit, configured to calculate a percentage of the abnormal frame in the speech signal; and if the percentage of the abnormal frame is greater than a fifth threshold, output speech distortion alarm information.

With reference to any one of the second aspect to the sixth possible implementation manner of the second aspect, in a ninth possible implementation manner, the apparatus further includes a first signal evaluation unit, configured to calculate a first speech quality evaluation value of the speech signal according to a detection result of a signal frame that needs to undergo abnormal frame detection, where the detection result indicates that any frame in the signal frame that needs to undergo the abnormal frame detection is a normal frame or an abnormal frame.

With reference to the ninth possible implementation manner of the second aspect, in a tenth possible implementation manner, when calculating the first speech quality evaluation value of the speech signal, the first signal evaluation unit is specifically configured to: obtain a percentage of the abnormal frame in the speech signal; and obtain, according to the percentage and a quality evaluation parameter, the first speech quality evaluation value corresponding to the percentage.

With reference to the ninth or the tenth possible implementation manner of the second aspect, in an eleventh possible implementation manner, the first signal evaluation unit is further configured to obtain a second speech quality evaluation value of the speech signal by using a speech quality assessment method; and obtain a third speech quality evaluation value according to the first speech quality evaluation value and the second speech quality evaluation value.

With reference to the eleventh possible implementation manner of the second aspect, in a twelfth possible implementation manner, when obtaining the third speech quality evaluation value according to the first speech quality evaluation value and the second speech quality evaluation value, the first signal evaluation unit is specifically configured to subtract the first speech quality evaluation value from the second speech quality evaluation value to obtain the third speech quality evaluation value.

With reference to any one of the second aspect to the eighth possible implementation manner of the second aspect, in a thirteenth possible implementation manner, the apparatus further includes a second signal evaluation unit, configured to: after a signal frame that is in the speech signal and that needs to undergo abnormal frame detection is detected, obtain an anomaly detection characteristic value of the speech signal according to a detection result of the signal frame that needs to undergo the abnormal frame detection; obtain an assessment characteristic value of the speech signal by using a speech quality assessment method; and obtain a fourth speech quality evaluation value according to the anomaly detection characteristic value and the assessment characteristic value by using an assessment system.

According to the abnormal frame detection method and apparatus provided in the embodiments of the present disclosure, each signal frame is processed, and local signal energy differences in a signal frame are compared, so that whether distortion occurs in a speech signal is detected, and whether a signal frame is an abnormal frame can be determined.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
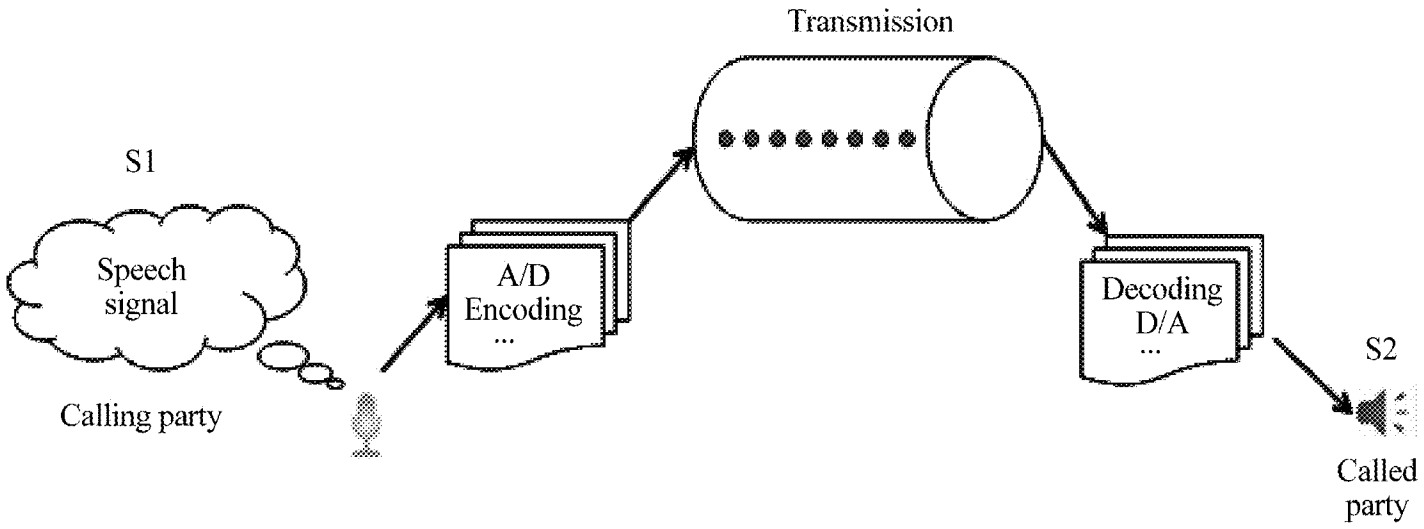
FIG. 1 is a schematic diagram of an application scenario of an abnormal frame detection method according to an embodiment of the present disclosure.

Embodiments of the present disclosure provide an abnormal frame detection method. The method can be used to detect whether each frame in a speech signal is a normal frame or an abnormal frame, and locate speech distortion in a time domain, that is, locate an abnormal frame of the speech signal. For an optional application scenario of the method, refer to FIG. 1. FIG. 1 is a schematic diagram of an application scenario of an abnormal frame detection method according to an embodiment of the present disclosure.

FIG. 1 shows a speech communication procedure. A sound is transmitted from a calling party to a called party. In the calling party, a signal before A/D conversion and encoding is defined as a reference signal S1. In view of negative impact imposed by encoding and transmission on speech quality, S1 usually has optimal quality in the entire procedure. Correspondingly, a signal after decoding and D/A conversion is defined as a received signal S2. Usually, S2 is inferior to S1 in quality. Therefore, the abnormal frame detection method in this embodiment may be used at a receive end to perform detection on the received signal S2, and may be specifically used to detect whether anomaly occurs in each frame in the received signal S2.

Figure 2:
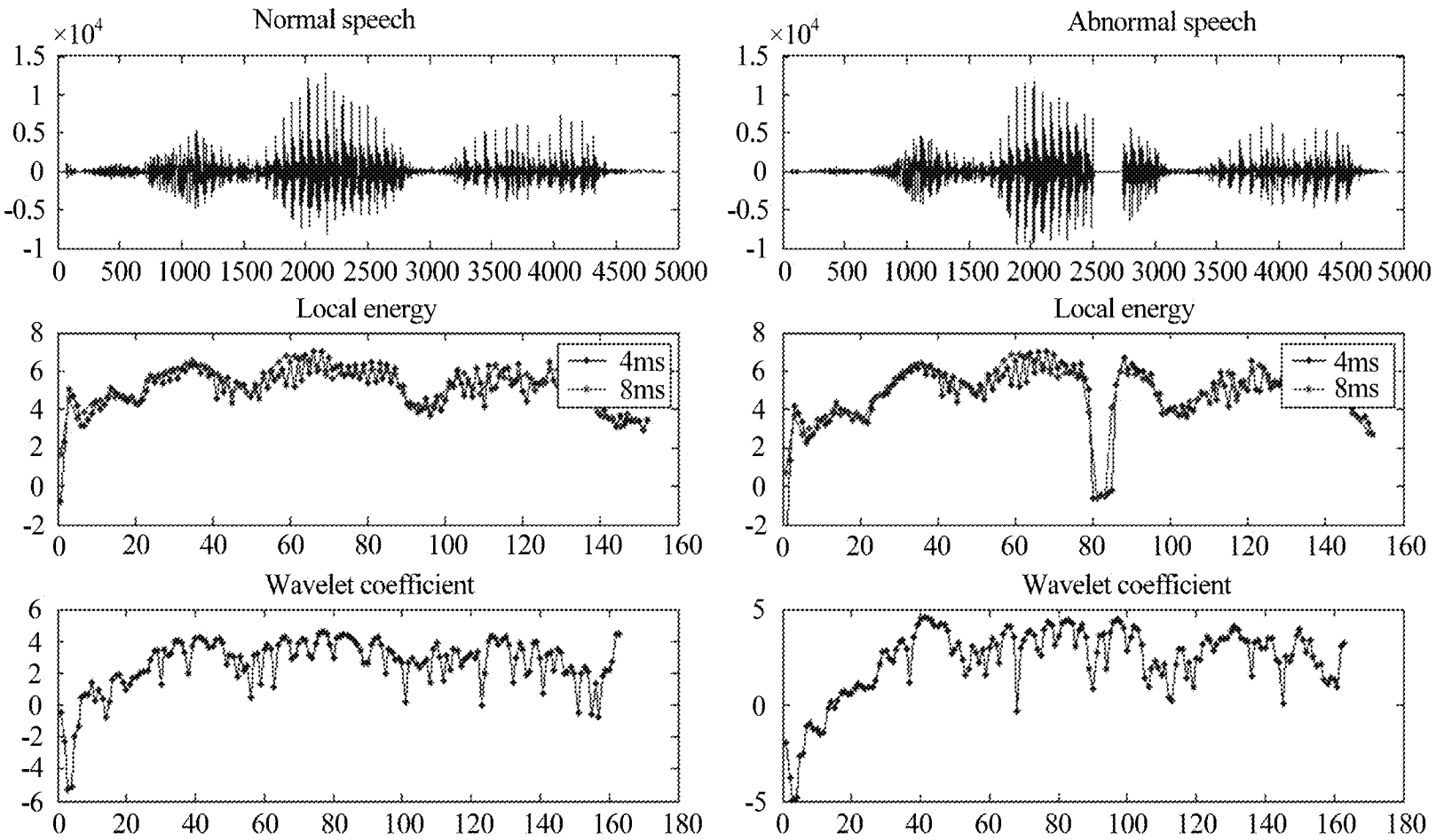
FIG. 2 is a schematic diagram of a speech difference in an abnormal frame detection method according to an embodiment of the present disclosure.

The following describes in detail how to perform speech detection according to the abnormal frame detection method in the embodiments of the present disclosure. To understand an idea of the method more easily and clearly, first, a main idea on which the abnormal frame detection method in the embodiments of the present disclosure is based is simply described. Referring to FIG. 2, FIG. 2 is a schematic diagram of a speech difference in an abnormal frame detection method according to an embodiment of the present disclosure. FIG. 2 shows a normal speech and an abnormal speech. The abnormal speech is a speech in which speech distortion occurs. It can be learned that there is an obvious difference between the normal speech and the abnormal speech. For example, in terms of local energy, local energy fluctuation of the abnormal speech is relatively large, and a local energy amplitude also fluctuates wildly. In terms of a wavelet coefficient, a jitter amplitude of a wavelet coefficient of the abnormal speech increases. In this embodiment of the present disclosure, a characteristic value that can reflect the foregoing difference is extracted from a speech signal, and the characteristic value is used to determine whether the foregoing difference is indicated, for example, whether a relatively large change in the local energy occurs, so as to determine whether distortion occurs in the speech signal.

It should be noted that in each embodiment of the present disclosure, each signal frame in a to-be-detected speech signal is processed by using the speech distortion detection method. In addition, each subframe in a currently processed signal frame is processed by using this method. However, this is merely an optional manner. In specific implementation, not all signal frames in a speech signal need to be processed, but only some signal frames may be selected and processed. In addition, when a signal frame is processed, not all subframes are processed, but some subframes in the signal frame may be selected and processed. For details, refer to the following embodiments.

Embodiment 1

Figure 3:
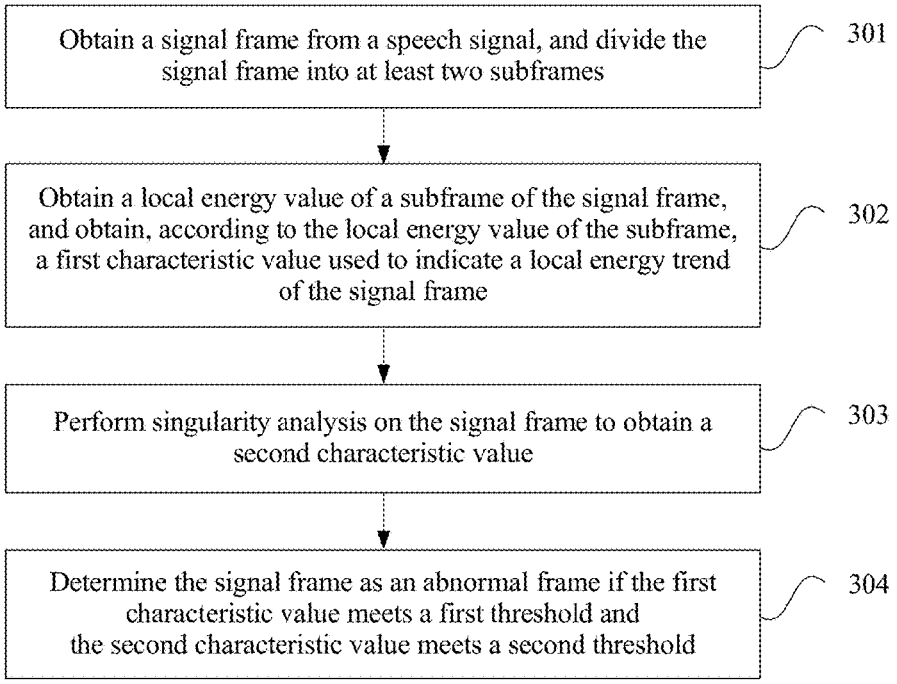
FIG. 3 is a schematic flowchart of an abnormal frame detection method according to an embodiment of the present disclosure.

FIG. 3 is a schematic flowchart of an abnormal frame detection method according to an embodiment of the present disclosure. The method in this embodiment can be used to perform detection on a to-be-tested speech signal. For example, the speech signal is S2 at the receive end in FIG. 1. In this embodiment, S2 is referred to as the "speech signal". As shown in FIG. 3, the method may include the following steps.

301. Obtain a signal frame from a speech signal, and divide the signal frame into at least two subframes.

In this embodiment, each frame of the speech signal is referred to as a "signal frame". In addition, it is assumed that a frame length of the signal frame in this embodiment is L_shift. That is, each signal frame includes L_shift samples of speech sampling. For ease of description, it is assumed that a total quantity of samples of the to-be-tested speech signal in this embodiment is exactly divisible by L_shift, and that the entire speech signal has N frames in total, that is, a speech signal s(n), where n=1, 2, 3, . . . , N. In addition, each signal frame is divided into at least two subframes. In this embodiment, it is assumed that each signal frame is divided into four subframes (certainly, this quantity can be changed in specific implementation), that is, the L_shift samples in each signal frame are evenly divided into four parts.

Figure 4:
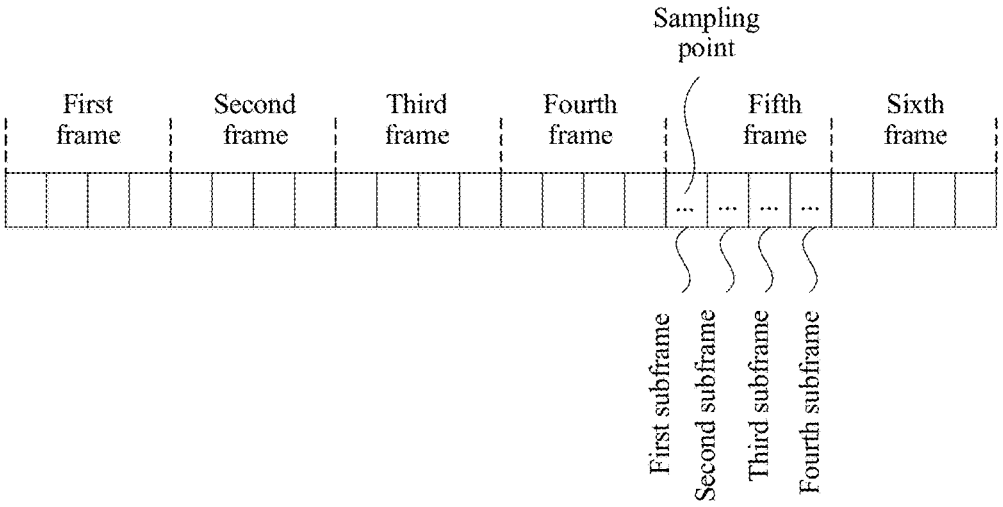
FIG. 4 is a schematic diagram of a speech signal in an abnormal frame detection method according to an embodiment of the present disclosure.

For example, referring to FIG. 4, FIG. 4 is a schematic diagram of a speech signal in an abnormal frame detection method according to an embodiment of the present disclosure. The speech signal has six signal frames in total: "a first frame, a second frame, . . . , and a sixth frame". That is, a maximum value N of n in s(n) is equal to 6. For a structure of each signal frame, the fifth frame is used as an example. The fifth frame is divided into four subframes: "a first subframe, a second subframe, . . . , and a fourth subframe". Each subframe includes Ns sampling points, and the sampling points are sampling points of speech sampling in a speech test. For example, the speech sampling is performed once every 1 ms. A quantity of sampling points included in the entire signal frame (that is, the four subframes in total) is 4×Ns. That is, a value of L_shift is 4×Ns. Certainly, practical sampling points have equal spacings in a time domain. FIG. 4 is merely an example.

According to the abnormal frame detection method in this embodiment, whether signal frames are abnormal is determined one by one. For example, whether the first frame is a normal frame or an abnormal frame is first determined to obtain a determining result. Next, whether the second frame is a normal frame or an abnormal frame is determined, then whether the third frame is a normal frame or an abnormal frame is determined, and so on. Therefore, how to determine each signal frame in the foregoing frames is described in steps 302 to 307, and each signal frame undergoes the following determining process. It should be noted that in steps 302 to 307, a sequence between the steps is not strictly limited in this embodiment, and sorting is performed merely for ease of description. In specific implementation, sequence numbers 302 to 307 do not set a limitation on an execution order of steps 302 to 307. For example, step 303 may be executed before step 302.

302. Obtain a local energy value of a subframe of the signal frame, and obtain, according to the local energy value of the subframe, a first characteristic value used to indicate a local energy trend of the signal frame.

In this step, whether a relatively large change occurs in energy is checked by calculating the local energy value. For example, as described above, compared with a normal speech, an abnormal speech has relatively large local energy fluctuation, and a local energy amplitude also fluctuates wildly. The first characteristic value calculated in this step can be used to indicate the local energy trend of the signal frame, and is calculated according to a local energy value of each subframe.

Optionally, the first characteristic value may be calculated according to the following method.

First, for one signal frame in the speech signal, a local energy value corresponding to each subframe in the signal frame is obtained, and a maximum value and a minimum value in all the local energy values corresponding to all the subframes are calculated.

In this embodiment, the fifth frame is used as a signal frame that needs to undergo anomaly determining. In this step, a local energy value corresponding to each subframe in the fifth frame is obtained. A local energy value of a subframe can be calculated according to formula (1), and local energy values corresponding to other subframes are also calculated according to this formula.

$$P = \log\left(\frac{M * \sum_{n=st}^{ed} s(n)^2}{\text{L_shift}}\right) \tag{1}$$

In formula (1), P is a local energy value of a signal frame, M is a quantity of subframes of the signal frame, st and ed are a start sampling point and an end sampling point of a current subframe, $s(n)^2$ is speech signal energy of the signal frame, and L_shift is a quantity of sampling points of the signal frame. For example, in an embodiment of the present disclosure, M=4, that is, each signal frame has four subframes in total; and L_shift=4×Ns, that is, each signal frame has 4×Ns sampling points in total, where Ns indicates a quantity of sampling points of a subframe. The fourth subframe in the fifth frame is used as an example. According to formula (i), a sum of signal energy of Ns sampling points in the fourth subframe is obtained, then the energy sum of the subframe is multiplied by a total quantity of subframes (that is, the fifth frame has four subframes in total) to obtain a product, and then the product is divided by a total quantity of samples of the fifth frame. Therefore, a local energy value corresponding to the fourth subframe in the fifth frame is obtained. By using the same method, local energy values respectively corresponding to the first subframe to the third subframe in the fifth frame are obtained by means of calculation. If the local energy values of the four subframes are put in an array, an array $P_{(i)}$ (j) may be defined to store these local energy values, where j=1, 2, . . . , M. The array $P_{(i)}$ (j) indicates local energy values of M subframes of an $i^{th}$ frame, and may be referred to as an array P.

In this embodiment, the maximum value and the minimum value of all the local energy values corresponding to all the subframes also need to be calculated. Using the fifth frame as an example, a maximum value $P_{Max}$ and a minimum value $P_{min}$ that are in a logarithm domain and that are of the array P corresponding to the fifth frame may be calculated.

Then, target correlated subframes in a correlated signal frame prior to the signal frame in a time domain are determined, and a local energy value corresponding to each target correlated subframe and a minimum value of all the local energy values are calculated. The correlated signal frame and the target correlated subframes in this embodiment refer to a signal frame or a subframe that affects a current signal frame and that can help obtain an energy trend. For example, if a local energy trend of a speech signal needs to be checked, the energy trend can be obtained only by considering one signal frame prior to the signal frame or two signal frames prior to the signal frame in the time domain together, instead of merely checking one signal frame in the speech signal. Therefore, the one or two signal frames prior to the signal frame can be referred to as a correlated signal frame. More specifically, last two subframes in the one signal frame prior to the signal frame are considered together to obtain the energy trend, and the last two subframes are target correlated subframes. For a specific example, refer to the following descriptions.

In this embodiment, a correlation between signals also needs to be considered, that is, a correlation between all signal frames of the speech signal. Therefore, the target correlated subframes in the correlated signal frame prior to the signal frame in the time domain also need to be determined. In this embodiment, the fifth frame that needs to be determined is used as an example. The local energy values corresponding to all the subframes in the fifth frame have been already calculated in step 302, the array P is used for storage, and the maximum value and the minimum value that are in the logarithm domain and that are of the local energy values have been already calculated. Therefore, in this step, the fourth frame can be considered. The fourth frame is prior to the fifth frame in the time domain, so that the fourth frame is referred to as the "correlated signal frame". In this embodiment, last two subframes of the fourth frame can be referred to as the "target correlated subframes". That is, impact imposed by the last two subframes of the fourth frame on the fifth frame needs to be considered.

An array Q can be defined, that is, $Q_{(i-1)}$ (j), where j=1, 2, . . . , M. The array Q indicates subframes from a (M/2+1)$^{th}$ subframe to an $M^{th}$ subframe in an (i−1)$^{th}$ signal frame, that is, a second half of subframes enumerated in this embodiment. The array Q is used to store local energy values corresponding to the last two subframes of the fourth frame. Certainly, the local energy values of the two subframes can be stored when the fourth frame is determined. A calculation method is the same as formula (1), and details are not described again. That is, local energy values are calculated in a same method, and "first" or "second" is used only for distinguishing subframes in different frames. "Third", "fourth", or the like appearing subsequently in this embodiment of the present disclosure is also used for distinguishing, and has not a strict limitation meaning. Specially, when i=1, the array Q is considered as an all-0 array by default. In this embodiment, a minimum value in all local energy values also needs to be calculated. For example, a minimum value $Q_{min}$ (i−1) that is in the logarithm domain and that is in the array Q corresponding to last two subframes of the fourth frame is calculated.

It should be noted that for the target correlated subframes in the correlated signal frame, the last two subframes of the fourth frame are used as an example in this embodiment. The target correlated subframes are changeable in specific implementation. For example, all subframes in the fourth frame may be used as target correlated subframes, or last three subframes of the fourth frame may be used as target correlated subframes. Further, both the third frame and the fourth frame may be used as correlated signal frames, and last two subframes of the third frame and all subframes in the fourth frame may be used as target correlated subframes. That is, specific implementation is not limited to the one example case in this embodiment.

Finally, the first characteristic value used to indicate a local energy difference is obtained according to the maximum value and the minimum value of the local energy values corresponding to the current signal frame, and the minimum value of the local energy values in the correlated signal frame.

Optionally, the first characteristic value can be defined as E1, and is obtained according to formula (2).

$$E1=\min\{P_{max}(i)-P_{Min}(i),\ P_{max}(i)-Q_{Min}(i-1)\} \quad (2)$$

In formula (2), $P_{Max}$ (i) indicates a maximum value of local energy values corresponding to all subframes of a current signal frame, $P_{min}$ (i) indicates a minimum value of the local energy values corresponding to all the subframes of the current signal frame, and $Q_{min}$ (i−1) indicates a minimum value in local energy values corresponding to target correlated subframes in a correlated signal frame.

The obtained E1 can reflect a subframe energy trend, that is, can reflect a local energy change shown in FIG. 2. In other words, E1 can reflect magnitude of a change in local energy shown in FIG. 2. In addition, it can be learned according to formula (2) that if a difference between the maximum value and the minimum value that are in the logarithm domain and that are of the local energy values is referred to as a first difference value, and a difference between the maximum value of the local energy values and the minimum value that is in the logarithm domain and that is of the local energy values is referred to as a second difference value, a smaller value between the first difference value and the second difference value may be selected as the first characteristic value E1.

Optionally, in this embodiment, the first characteristic value may be calculated in the following manner: When the first characteristic value is calculated, only the maximum value and the minimum value of the local energy values need to be used, and the first difference value, that is, the difference between the maximum value and the minimum value, is assigned to the first characteristic value. In other words, correlation information of a prior subframe is abandoned and only information about the current frame is used. In another embodiment, the second difference value may be directly used as the first characteristic value.

303. Perform singularity analysis on the signal frame to obtain a second characteristic value.

In this step, the singularity analysis (Singularity analysis) is performed on the signal frame. The singularity analysis may be local singularity analysis or may be global singularity analysis. The singularity refers to an image texture, a signal cusp, or the like. A difference between a normal frame and an abnormal frame is reflected by using changes in important characteristics of these signals, and a characteristic value obtained by means of singularity analysis is referred to as the second characteristic value. The second characteristic value is used to indicate a singularity characteristic, that is, some characteristic values of the foregoing singularity.

In specific implementation, the singularity analysis includes multiple manners, such as Fourier transform, wavelet analysis, and multifractals. In this embodiment, a wavelet coefficient is selected as a characteristic of the singularity analysis. Referring to FIG. 2, jitter amplitudes of wavelet coefficients of a normal speech and an abnormal speech have a relatively obvious difference. Therefore, optionally, in this embodiment, the singularity analysis is performed on the signal frame by using a wavelet analysis method as an example. However, it may be understood by persons skilled in the art that practical implementation is not limited to the wavelet analysis method. Certainly, multiple other singularity analysis manners may be used, and other parameters may be selected as a characteristic of the singularity analysis. Details are not described. The following describes the singularity analysis by using only the wavelet analysis method.

First, wavelet decomposition is performed on the signal frame to obtain a wavelet coefficient, and signal reconstruction is performed according to the wavelet coefficient to obtain a reconstructed signal frame.

Specifically, a wavelet function may be selected (in other words, a group of quadrature mirror filters (QMF) is selected), and an appropriate decomposition level (for example, a level 1) is selected, to perform wavelet decomposition on the signal frame, for example, on the fifth frame. It should be noted that only a wavelet coefficient $CA_L$ of an estimation part in the wavelet decomposition is required in this embodiment. The signal reconstruction is performed according to a wavelet reconstruction theory and according to the wavelet coefficient. A corresponding wavelet signal may be restored by using a reconstruction filter, and is referred to as a reconstructed signal frame W(n).

Then, according to a maximum local energy value and an average local energy value that are in the logarithm domain and that are in local energy values of all subframes in the reconstructed signal frame, the second characteristic value used to indicate a difference between the maximum local energy value and the average local energy value is obtained.

In this embodiment, after the reconstructed signal frame is calculated, that is, after the wavelet reconstruction signal W(n) is obtained, a local energy value of each sampling point in the reconstructed signal frame is calculated, that is, the square of each sampling point in the W(n) is $W^2$ (n). A maximum value and an average value of an array $W^2$ (n) are calculated. The maximum value may be referred to as the maximum local energy value, and the average value may be referred to as the average local energy value. The second characteristic value that reflects the difference of the maximum local energy value and the average local energy value may be obtained according to the maximum local energy value and the average local energy value. It can be learned from FIG. 2 that the difference between the maximum local energy value and the average local energy value is equivalent to a jitter amplitude of the wavelet coefficient in FIG. 2.

Optionally, the difference between the maximum local energy value and the average local energy value that are in the logarithm domain and that are in the reconstructed signal frame can be used as the second characteristic value. If the second characteristic value is defined as $E2$, $E2$ is calculated by using formula (3):

$$E2=\max(\log(W^2(n)))-\text{average}(\log(W^2(n))) \quad (3),$$

where max(log($W^2$ (n))) and average(log($W^2$ (n))) are a maximum value and an average value of $W^2$ (n) in the logarithm domain respectively.

In addition, optionally, in this embodiment, formula (i) is used to indicate the first characteristic value of the local energy difference. However, practical implementation is not limited to the formula, provided that a local energy change can be reflected. Likewise, in this embodiment, formula (3) is used to indicate the second characteristic value. Specific implementation is not limited to the formula either, provided that a wavelet signal change can be indicated.

304. Determine the signal frame as an abnormal frame if the first characteristic value meets a first threshold and the second characteristic value meets a second threshold.

In this embodiment, if the first characteristic value E1 meets a preset first threshold THD1, for example, a condition that E1 is greater than or equal to THD1 is met, and if the second characteristic value E2 meets a preset second threshold THD2, for example, a condition that E2 is greater than or equal to THD2 is met, that is, the two conditions are met, the signal frame is considered as an abnormal frame. That is, the fifth frame is an abnormal frame in this embodiment.

Values of the first threshold THD1 and the second threshold THD2 are not limited in this embodiment, and can be set according to a specific implementation status. For example, the first characteristic value E1 can reflect an amplitude change of the local energy in FIG. 2. Therefore, specifically, which change value of the amplitude change is considered as an abnormal signal can be set independently. Correspondingly, a value of the first threshold THD1 is set. Likewise, the second characteristic value E2 can reflect the jitter amplitude of the wavelet coefficient in FIG. 2. Therefore, specifically, which change value of the amplitude change is considered as an abnormal signal can be set independently. Correspondingly, a value of the second threshold THD2 is set.

In addition, if the first characteristic value E1 does not meet the preset first threshold THD1, a current frame is considered as a normal frame. Alternatively, if the second characteristic value E2 does not meet the preset second threshold THD2, a current frame is considered as a normal frame.

It should be noted that in this embodiment, provided that the first characteristic value meets the first threshold and the second characteristic value meets the second threshold, the signal frame can be determined as an abnormal frame when both conditions are met. However, which condition is determined first is not limited in this embodiment. Optionally, first, the first characteristic value may be calculated and whether the first characteristic value meets the first threshold is determined. If the first characteristic value meets the first threshold, the second characteristic value is further calculated and whether the second characteristic value meets the second threshold is determined.

After step 304 is executed, if the fifth frame may be determined as an abnormal frame, determining is performed on a next frame, that is, the sixth frame. Whether the sixth frame is a normal frame or an abnormal frame is determined. A process of determining the sixth frame is the same as that of determining the fifth frame. Refer to step 302 to step 304.

According to the abnormal frame detection method provided in this embodiment, speech distortion, that is, a signal frame in which the speech distortion occurs, may be rapidly and accurately located by processing each signal frame and making a comparison of local signal energy changes in the signal frame and of changes in a wavelet domain, so that whether distortion occurs in a speech signal is detected. In addition, speech distortion detection is simple and rapid by using the method in this embodiment, and accuracy is higher because the detection is performed according to a difference between a normal speech and an abnormal speech.

To further understand the abnormal frame detection method in this embodiment more clearly, the following gives further descriptions: As described above, in this method, whether the speech signal has a specific difference characteristic is detected to determine whether distortion occurs. The specific difference characteristic is a change in local energy and a change in a wavelet coefficient shown in FIG. 2. For a method of determining whether a change in local energy and a change in a wavelet coefficient occur in a speech signal, in the method provided in this embodiment, signal frames are determined one by one, an average energy value of sampling points of each subframe in each signal frame is calculated, and magnitude of a change in the average energy values is checked to determine whether a signal has a great energy change within a short time. For a wavelet coefficient, in this embodiment, after wavelet decomposition is performed on a signal frame to obtain the wavelet coefficient, the signal frame is reconstructed according to the wavelet coefficient, and whether a jitter amplitude of sampling point energy in the reconstructed signal frame meets a preset threshold is determined. According to the method in this embodiment, the characteristic differences shown in FIG. 2 can be indicated, and a time in which the speech distortion occurs can be rapidly and accurately determined.

It should be noted that because the speech distortion needs to be located in the time domain, a relatively high time resolution is required. That is, because a difference of two aspects shown in FIG. 2 occurs in the time domain, and distortion has a relatively obvious characteristic in the time domain, a signal processing tool of wavelet transform is used in the method in this embodiment. In the wavelet transform, a scale can be set to determine an appropriate time-frequency resolution corresponding to the scale, and an appropriate wavelet coefficient can be selected to determine an appropriate scale, so that a time resolution that easily displays the foregoing difference can be obtained. A corresponding characteristic value can be obtained on the appropriate scale, and the characteristic value is used to determine whether there is a difference, so as to further implement speech distortion detection. It can be learned from the foregoing descriptions that the method in this embodiment fits a feature of the speech distortion, and by using an appropriate signal analysis tool, the characteristic value that reflects a distortion difference can be obtained accurately and obviously. Therefore, a speech distortion detection result can be obtained more rapidly and accurately.

Embodiment 2

In Embodiment 1, how to extract a characteristic value that can reflect a distortion difference and how to perform distortion detection according to the characteristic value are mainly described. In this embodiment, after a detection result of each frame in a speech signal is obtained, smoothing processing is performed on the detection result. For example, detection results of the six signal frames in FIG. 4 have already been obtained: The first frame is a normal frame, the second frame is an abnormal frame, . . . , and the sixth frame is an abnormal frame. In this case, smoothing processing may be performed on the detection results by using the method in this embodiment.

Optionally, if a spacing between two neighboring abnormal frames is less than a third threshold, a normal frame located between the two neighboring abnormal frames is adjusted to an abnormal frame. For example, as shown in FIG. 4, if the second frame is an abnormal frame, the fifth frame is an abnormal frame, and the third frame and the fourth frame are normal frames, the second frame and the fifth frame are two neighboring abnormal frames, and a spacing between the two neighboring abnormal frames is "two frames". If the third threshold THD3 is one frame, the "two frames" is greater than the third threshold. It indicates that a spacing between the two neighboring abnormal frames is large enough, and no smoothing processing is required. However, if the third threshold is three frames, the "two frames" are less than the third threshold. It indicates that the spacing between the two neighboring abnormal frames, that is, a time interval, is extremely short. According to a short-time correlation of a signal, the normal frame between the two neighboring abnormal frames can be adjusted to an abnormal frame, that is, both the third frame and the fourth frame are adjusted to abnormal frames.

Optionally, after a speech distortion detection result is obtained, a quantity of abnormal frames in the speech signal can be counted. If the quantity of abnormal frames is less than a fourth threshold, all abnormal frames in the speech signal are adjusted to normal frames. In a speech signal, if a quantity of distorted frames is less than a pre-defined fourth threshold THD4, it indicates that very few abnormal events occur in the entire speech signal. This anomaly generally cannot be heard from a perspective of auditory perception analysis. Therefore, detection results of all frames may be adjusted to normal frames, that is, no distortion occurs in the speech signal. For example, FIG. 4 is still used as an example. If there is only one abnormal frame in the six signal frames, for example, the fifth frame is an abnormal frame, the other frames are normal frames, and the fourth threshold is two frames, a quantity "1" of abnormal frames is less than the fourth threshold. In this case, no distortion in the speech signal may be considered, that is, a detection result of the fifth frame is adjusted to a normal frame.

In this embodiment, smoothing processing is performed on a speech distortion detection result, practical auditory perception may be more suited, and auditory feeling of a manual test may be simulated more accurately.

Embodiment 3

After whether distortion occurs in each signal frame in a speech signal is determined, in practical application, a determining result is used for speech quality assessment. For example, in a daily speech quality test, the method provided in this embodiment of the present disclosure may be used for determining, so that whether anomaly occurs in each frame can be determined. If a speech quality assessment result is output, according to the method provided in this embodiment and according to a processing result of each signal frame (for example, the processing result is whether the signal frame is a normal frame or an abnormal frame), speech quality scores corresponding to a quantity of abnormal frames are determined, and speech quality of a quantized speech signal is calculated and can be indicated by using a first speech quality evaluation value.

Optionally, there may be multiple manners of calculating the first speech quality evaluation value of the speech signal according to the processing result of the signal frame. For example, a MOS score or a distortion coefficient of the speech signal can be calculated based on a percentage of the abnormal frame in all signal frames in the speech signal. Certainly, in specific implementation, another manner may be used. For another example, ANIQUE+ uses recency effect principle. For each independent abnormal event, a distortion coefficient is calculated based on a time length of the independent abnormal event; and then a distortion coefficient of an entire speech file is obtained according to the recency effect principle.

Specifically, according to formula (4), the percentage of the abnormal frame in all the signal frames in the speech signal can be calculated.

$$R_{loss} = \frac{\text{nframe_artifact}}{nframe} * 100\% \tag{4}$$

In the formula, nframe is a quantity of all signal frames in a speech signal, nframe_artifact indicates a distorted abnormal frame in the speech signal, and $R_{loss}$, is a percentage of the abnormal frame in all the signal frames.

Then, the first speech quality evaluation value corresponding to the percentage is obtained according to the percentage and a quality evaluation parameter. Refer to formula (5):

$$Y=5-\alpha*R_{loss}{}^{m} \tag{5}.$$

In formula (5), Y indicates the first speech quality evaluation value, and may be a MOS score, and "5" is defined because an internationally accepted MOS range is from 1 to 5. In the formula, a and m are quality evaluation parameters, and can be obtained by means of data training.

According to the speech quality assessment in this embodiment, a percentage of an abnormal frame is directly mapped to a corresponding first speech quality evaluation value such as a MOS score. This case is relatively applicable to speech distortion caused by encoding or channel transmission. When an influencing factor of the speech distortion further includes noise or the like, the method in this embodiment may be combined with another speech quality assessment method to better assess the speech quality. For example, Embodiment 4 is an optional quality assessment manner.

Embodiment 4

In this embodiment, after the first speech quality evaluation value in Embodiment 3 is obtained, and a second speech quality evaluation value is further obtained by using a speech quality assessment method. The speech quality assessment method herein refers to another method different from the method in Embodiment 3, such as auditory non-intrusive quality estimation plus (ANIQUE+). In addition, the ANIQUE+ is combined with the method in Embodiment 3, and a third speech quality evaluation value is obtained according to the first speech quality evaluation value and the second speech quality evaluation value.

Specifically, first, in a system training process, the second speech quality evaluation value needs to be used to train a first speech quality evaluation system, that is, a system for calculating the first speech quality evaluation value. Specifically, the ANIQUE+ is used to perform quality assessment on the speech signal, to obtain the second speech quality evaluation value. In this embodiment, it may be assumed that all speech quality evaluation values are MOS scores. Therefore, the second speech quality evaluation value is a second MOS score. In view of a dynamic range of the MOS score, a corresponding quality evaluation parameter needs to be selected according to the second speech quality evaluation value, that is, values of a and m in formula (5) are appropriately adjusted according to a scoring result of the ANIQUE+. From a perspective of data analysis, by selecting a specific speech subjectivity database (the database includes a speech file and a subjective MOS score), first, the ANIQUE+ can be used for scoring; then data fitting is performed again based on a difference between the subjective MOS score in the database and the second MOS score, and values of a and m are updated. In this case, adaptation between the values of a and m and an assessment result of the ANIQUE+ is performed.

Then, the first speech quality evaluation value such as a first MOS score is obtained according to formula (5) by using updated a and m, and a percentage of an abnormal frame. Then, based on the second MOS score, the first MOS score is subtracted from the second MOS to obtain the third speech quality evaluation value, that is, a final MOS score.

It should be noted that for a process of obtaining the second speech quality evaluation value by using another speech quality assessment method, the ANIQUE+ is used as an example for description in this embodiment. Other quality assessment methods may be used in practical application, and no limitation is set in this embodiment.

Embodiment 5

In Embodiment 3 and Embodiment 4, a manner for obtaining a speech quality evaluation value according to a percentage of an abnormal frame in all signal frames of a speech signal is used. A difference between this embodiment and the foregoing two embodiments lies in that an anomaly detection characteristic value used in the abnormal frame detection method in this embodiment of the present disclosure may be directly used in another speech quality assessment method to obtain a third speech quality evaluation value, instead of mapping the percentage to a MOS score. For example, the anomaly detection characteristic value includes at least one of the following: a local energy value, a first characteristic value, or a second characteristic value. All these characteristic values are characteristic parameters used in the method in Embodiment 1.

In this embodiment, according to a combination of an assessment characteristic value extracted in a speech quality assessment method used in a current process of calculating a second speech quality evaluation value, and a corresponding anomaly detection characteristic value in a process of calculating the first speech quality evaluation value in the foregoing embodiment of the present disclosure, the third speech quality evaluation value can be obtained by using a machine learning system (such as a neural network system). The anomaly detection characteristic value is obtained in a process of obtaining the first speech quality evaluation value, and the assessment characteristic value is obtained in a process of obtaining the second speech quality evaluation value.

Specifically, the following method may be used. In an ANIQUE+ method, by means of human auditory modeling, a characteristic vector that reflects auditory perception (which is defined as $\varepsilon\{i\}$, $i=1, 2, \ldots, D$) is obtained. The characteristic vector may be referred to as the assessment characteristic value, and D is a dimension of the characteristic vector. By means of large-sample training, a neural network system in which E is mapped to a MOS score is obtained. Therefore, the anomaly detection characteristic value (such as the first characteristic value or the second characteristic value) extracted in this embodiment of the present disclosure can be used as a complementary set, and is complemented to the characteristic vector, that is, $\varepsilon\{i\}$, $i=1, 2, \ldots, D+1$, and the dimension of the characteristic vector is added to D+1. Similarly, by means of large-sample training, a new neutral network model can be obtained for speech quality assessment. That is, according to the characteristic vector and the neutral network system that is obtained by means of ANIQUE+ training, the third speech quality evaluation value corresponding to the characteristic vector is obtained. A characteristic of the added one dimension is a characteristic value obtained by using the method in Embodiment 1, and may be the percentage of the abnormal frame, or may be similar to a method based on recency effect principle in ANIQUE+. This is not limited herein.

Embodiment 6

In Embodiment 3 to Embodiment 5, application of a speech distortion detection result to speech quality assessment is described. In addition, the speech distortion detection result may also be used for speech quality alarming.

For example, after the speech distortion detection result is obtained, a quantity of abnormal frames in a speech signal per unit of time may be counted. If the quantity of abnormal frames is greater than a fifth threshold, speech distortion alarm information is output. For example, the alarm information may be text information or symbol identifiers indicating relatively poor speech quality, or may be alarm information in another form such as a sound alarm. For example, if in the six signal frames in FIG. 4, a quantity of abnormal frames is 4, and the fifth threshold is 3 (a quantity of frames), the quantity of abnormal frames is greater than the fifth threshold. In this case, the speech distortion alarm information can be output to indicate a failure in this speech test, and speech quality needs to be improved.

Two types of application of the speech distortion detection result are enumerated above, such as speech quality evaluation and speech alarming. In practical implementation, there may be application in another aspect, and details are not described in this embodiment of the present disclosure.

In addition, before a percentage of an abnormal frame in all signal frames is calculated, first, smoothing processing may be performed on the signal frames. For example, as described above, when a spacing between two abnormal frames is less than a third threshold, a normal frame between the two abnormal frames is adjusted to an abnormal frame. Then a percentage of all abnormal frames obtained after smoothing processing in the signal frame is calculated.

Embodiment 7

Figure 5:
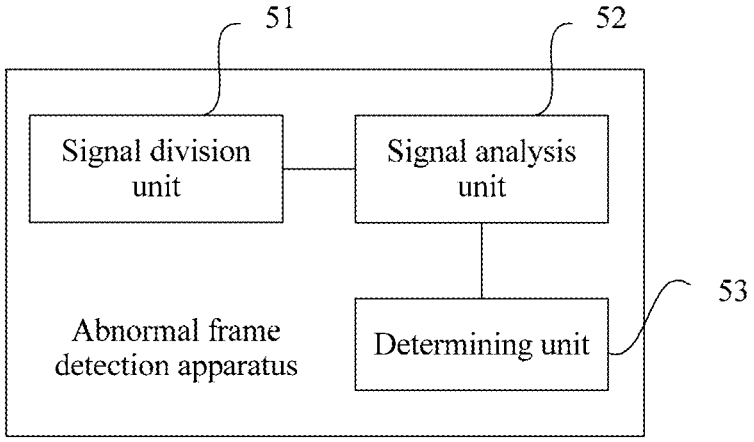
FIG. 5 is a schematic structural diagram of an abnormal frame detection apparatus according to an embodiment of the present disclosure.

FIG. 5 is a schematic structural diagram of an abnormal frame detection apparatus according to an embodiment of the present disclosure. The apparatus can execute the method in any embodiment of the present disclosure. In this embodiment, only a structure of the apparatus is briefly described. For a specific operating principle of the apparatus, refer to the method embodiments. As shown in FIG. 5, the apparatus may include: a signal division unit 51, a signal analysis unit 52, and a determining unit 53.

The signal division unit 51 is configured to obtain a signal frame from a speech signal, and divide the signal frame into at least two subframes.

The signal analysis unit 52 is configured to: obtain a local energy value of a subframe of the signal frame; obtain, according to the local energy value of the subframe, a first characteristic value used to indicate a local energy trend of the signal frame; and perform singularity analysis on the signal frame to obtain a second characteristic value used to indicate a singularity characteristic of the signal frame.

The determining unit 53 is configured to determine the signal frame as an abnormal frame when the first characteristic value of the signal frame meets a first threshold and the second characteristic value of the signal frame meets a second threshold.

Further, when calculating the first characteristic value, the signal analysis unit 52 is specifically configured to: obtain a maximum local energy value and a minimum local energy value that are in a logarithm domain and that are in local energy values of all the subframes in the signal frame; and perform subtraction on the maximum local energy value and the minimum local energy value that are in the logarithm domain to obtain a first difference value, where the first difference value is the first characteristic value.

Further, when calculating the first characteristic value, the signal analysis unit 52 is specifically configured to: determine target correlated subframes in a correlated signal frame prior to the signal frame in a time domain, and calculate local energy values of the target correlated subframes to obtain a minimum local energy value that is in a logarithm domain and that is in the local energy values of the target correlated subframes; obtain a maximum local energy value that is in the logarithm domain and that is in local energy values of all the subframes of the signal frame; and perform subtraction on the maximum local energy value and the minimum local energy value that are in the logarithm domain to obtain a second difference value, where the second difference value is the first characteristic value.

Further, when calculating the first characteristic value, the signal analysis unit 52 is specifically configured to: obtain a maximum local energy value and a minimum local energy value that are in a logarithm domain and that are in local energy values of all the subframes in the signal frame; determine target correlated subframes in a correlated signal frame prior to the signal frame in a time domain, and calculate local energy values of the target correlated subframes to obtain a minimum local energy value that is in the logarithm domain and that is in the local energy values of the target correlated subframes; perform subtraction on the maximum local energy value and the minimum local energy value that are in the logarithm domain and that are in the local energy values of all the subframes in the signal frame to obtain a first difference value; perform subtraction on the maximum local energy value that is in the logarithm domain and that is in the local energy values of all the subframes in the signal frame and the minimum local energy value that is in the logarithm domain and that is in the local energy values of the target correlated subframes to obtain a second difference value; and select, between the first difference value and the second difference value, a smaller value as the first characteristic value.

Further, when calculating the second characteristic value, the signal analysis unit 52 is specifically configured to: perform wavelet decomposition on the signal frame to obtain a wavelet coefficient, and obtain the second characteristic value according to a maximum local energy value and an average local energy value that are in the logarithm domain and that are in local energy values of all subframes of a reconstructed signal frame.

Further, the signal analysis unit 52 performs the wavelet decomposition on the signal frame to obtain the wavelet coefficient, and obtains the second characteristic value according to the maximum local energy value and the average local energy value that are in the logarithm domain and that are in the local energy values of all the subframes of the reconstructed signal frame.

Figure 6:
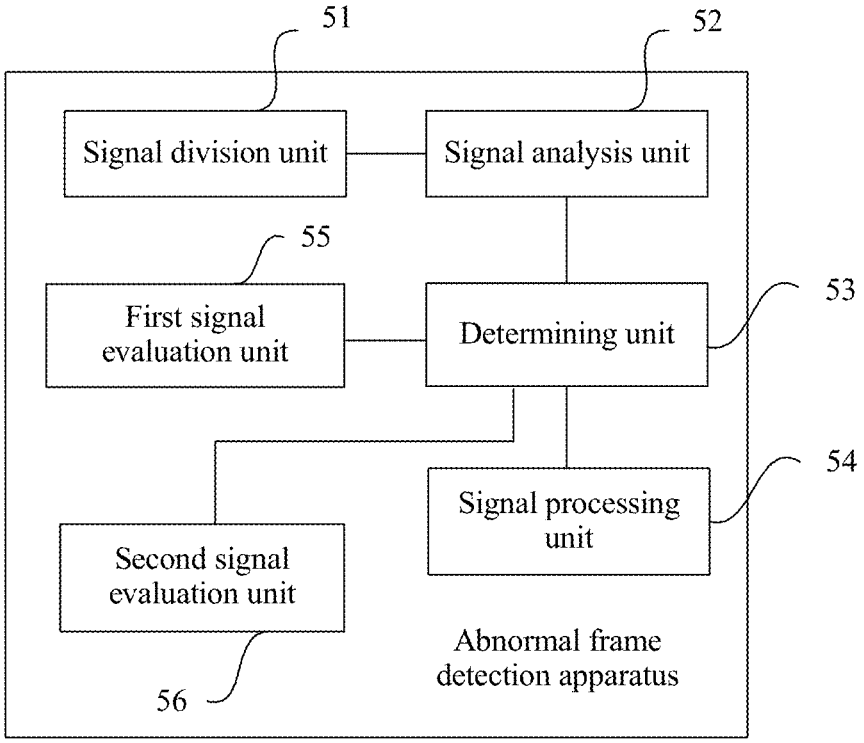
FIG. 6 is a schematic structural diagram of another abnormal frame detection apparatus according to an embodiment of the present disclosure.

FIG. 6 is a schematic structural diagram of another abnormal frame detection apparatus according to an embodiment of the present disclosure. As shown in FIG. 6, based on the structure shown in FIG. 5, the apparatus may further include a signal processing unit 54, configured to: when a spacing between the signal frame and a prior abnormal frame in the speech signal is less than a third threshold and if the signal frame is an abnormal frame, adjust a normal frame between the signal frame and the prior abnormal frame to an abnormal frame.

In another embodiment, the signal processing unit 54 is configured to count a quantity of abnormal frames in the speech signal, and if the quantity of abnormal frames is less than a fourth threshold, adjust all abnormal frames in the speech signal to normal frames.

In still another embodiment, the signal processing unit 54 is configured to calculate a percentage of the abnormal frame in the speech signal; and if the percentage of the abnormal frame is greater than a fifth threshold, output speech distortion alarm information.

Referring to FIG. 6, the apparatus may further include a first signal evaluation unit 55 and a second signal evaluation unit 56.

The first signal evaluation unit 55 is configured to calculate a first speech quality evaluation value of the speech signal according to a detection result of a signal frame that needs to undergo abnormal frame detection. The detection result indicates that any frame in the signal frame that needs to undergo the abnormal frame detection is a normal frame or an abnormal frame.

Further, when calculating the first speech quality evaluation value of the speech signal, the first signal evaluation unit 55 is specifically configured to: obtain a percentage of the abnormal frame in the speech signal; and obtain, according to the percentage and a quality evaluation parameter, the first speech quality evaluation value corresponding to the percentage.

Further, the first signal evaluation unit 55 is further configured to obtain a second speech quality evaluation value of the speech signal by using a speech quality assessment method; and obtain a third speech quality evaluation value according to the first speech quality evaluation value and the second speech quality evaluation value.

Further, when obtaining the third speech quality evaluation value according to the first speech quality evaluation value and the second speech quality evaluation value, the first signal evaluation unit 55 is specifically configured to subtract the first speech quality evaluation value from the second speech quality evaluation value to obtain the third speech quality evaluation value.

After a signal frame that is in the speech signal and that needs to undergo abnormal frame detection is detected, the second signal evaluation unit 56 is configured to: obtain an anomaly detection characteristic value of the speech signal according to a detection result of the signal frame that needs to undergo the abnormal frame detection; obtain an assessment characteristic value of the speech signal by using a speech quality assessment method; and obtain a fourth speech quality evaluation value according to the anomaly detection characteristic value and the assessment characteristic value by using an assessment system.

Embodiment 8

Figure 7:
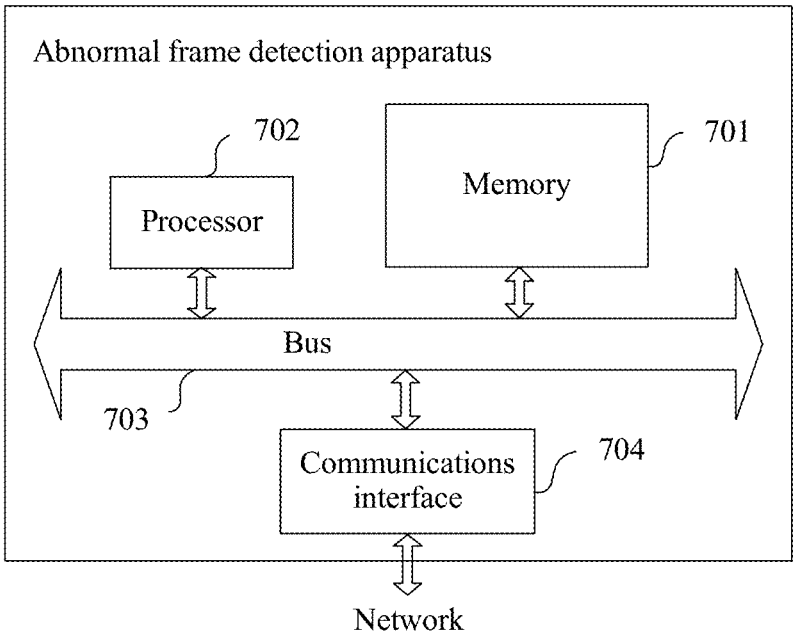
FIG. 7 is a schematic structural diagram of an entity of an abnormal frame detection apparatus according to an embodiment of the present disclosure.

FIG. 7 is a schematic structural diagram of an entity of an abnormal frame detection apparatus according to an embodiment of the present disclosure, configured to implement the abnormal frame detection method in the embodiments of the present disclosure. For an operating principle of the apparatus, refer to the foregoing method embodiments. As shown in FIG. 7, the apparatus may include: a memory 701, a processor 702, a bus 703, and a communications interface 704. The processor 702, the memory 701, and the communications interface 704 are connected and perform mutual communication by using the bus 703.

The processor 702 is configured to: obtain a signal frame from a speech signal; divide the signal frame into at least two subframes; obtain a local energy value of a subframe of the signal frame; obtain, according to the local energy value of the subframe, a first characteristic value used to indicate a local energy trend of the signal frame; perform singularity analysis on the signal frame to obtain a second characteristic value used to indicate a singularity characteristic of the signal frame; and determine the signal frame as an abnormal frame if the first characteristic value of the signal frame meets a first threshold and the second characteristic value of the signal frame meets a second threshold.

Persons of ordinary skill in the art may understand that all or some of the steps of the method embodiments may be implemented by a program instructing relevant hardware. The program may be stored in a computer-readable storage medium. When the program runs, the steps of the method embodiments are performed. The foregoing storage medium includes: any medium that can store program code, such as a read-only memory (ROM), a random access memory (RAM), a magnetic disk, or an optical disc.

Finally, it should be noted that the foregoing embodiments are merely intended to describe the technical solutions of the present disclosure, but not to limit the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. An method comprising:

obtaining a signal frame from a speech signal;

dividing the signal frame into at least two subframes;

obtaining a local energy value of a subframe of the signal frame;

obtaining, according to the local energy value of the subframe, a first characteristic value used to indicate a local energy trend of the signal frame;

performing singularity analysis on the signal frame to obtain a second characteristic value used to indicate a singularity characteristic of the signal frame; and determining the signal frame as an abnormal frame if the first characteristic value of the signal frame meets a first threshold and the second characteristic value of the signal frame meets a second threshold.

2. The method according to claim 1, wherein obtaining the first characteristic value used to indicate the local energy trend of the signal frame comprises:

obtaining a maximum local energy value and a minimum local energy value that are in a logarithm domain and that are in local energy values of all the subframes in the signal frame; and performing a subtraction on the maximum local energy value and the minimum local energy value that are in the logarithm domain to obtain a first difference value, and wherein the first difference value is the first characteristic value.

3. The method according to claim 1, wherein obtaining the first characteristic value used to indicate the local energy trend of the signal frame comprises:

determining target correlated subframes in a correlated signal frame prior to the signal frame in a time domain, and calculating local energy values of the target correlated subframes to obtain a minimum local energy value that is in a logarithm domain and that is in the local energy values of the target correlated subframes;

obtaining a maximum local energy value that is in the logarithm domain and that is in local energy values of all the subframes of the signal frame; and performing a subtraction on the maximum local energy value and the minimum local energy value that are in the logarithm domain to obtain a second difference value, wherein the second difference value is the first characteristic value.

4. The method according to claim 1, wherein obtaining the first characteristic value used to indicate the local energy trend of the signal frame comprises:

obtaining a maximum local energy value and a minimum local energy value that are in a logarithm domain and that are in local energy values of all the subframes in the signal frame;

determining target correlated subframes in a correlated signal frame prior to the signal frame in a time domain, and calculating local energy values of the target correlated subframes to obtain a minimum local energy value that is in the logarithm domain and that is in the local energy values of the target correlated subframes;

performing a subtraction on the maximum local energy value and the minimum local energy value that are in the logarithm domain and that are in the local energy values of all the subframes in the signal frame to obtain a first difference value;

performing subtraction on the maximum local energy value that is in the logarithm domain and that is in the local energy values of all the subframes in the signal frame and the minimum local energy value that is in the logarithm domain and that is in the local energy values of the target correlated subframes to obtain a second difference value; and selecting, between the first difference value and the second difference value, a smaller value as the first characteristic value.

5. The method according to claim 1, wherein performing the singularity analysis on the signal frame to obtain the second characteristic value used to indicate the singularity characteristic comprises:

performing wavelet decomposition on the signal frame to obtain a wavelet coefficient, and performing signal reconstruction according to the wavelet coefficient to obtain a reconstructed signal frame; and obtaining the second characteristic value according to a maximum local energy value and an average local energy value that are in a logarithm domain and that are in local energy values of all subframes of the reconstructed signal frame.

6. The method according to claim 5, wherein obtaining the second characteristic value according to the maximum local energy value and the average local energy value that are in the logarithm domain and that are in local energy values of all subframes of the reconstructed signal frame comprises performing a subtraction on the maximum local energy value and the average local energy value that are in the logarithm domain and that are in the local energy values of all the subframes of the reconstructed signal frame, and wherein an obtained difference value is the second characteristic value.

7. The method according to claim 1, further comprising, if a spacing between the signal frame and a prior abnormal frame in the speech signal is less than a third threshold and after determining the signal frame as an abnormal frame, adjusting a normal frame between the signal frame and the prior abnormal frame to an abnormal frame.

8. The method according to claim 1, further comprising:

after a signal frame that is in the speech signal and that needs to undergo abnormal frame detection is detected, counting a quantity of abnormal frames in the speech signal; and if the quantity of abnormal frames is less than a fourth threshold, adjusting all abnormal frames in the speech signal to normal frames.

9. The method according to claim 1, further comprising:

after a signal frame that is in the speech signal and that needs to undergo abnormal frame detection is detected, calculating a percentage of the abnormal frame in the speech signal;

and if the percentage of the abnormal frame is greater than a fifth threshold, outputting speech distortion alarm information.

10. The method according to claim 1, further comprising, after a signal frame that is in the speech signal and that needs to undergo abnormal frame detection is detected, calculating a first speech quality evaluation value of the speech signal according to a detection result of the signal frame that needs to undergo the abnormal frame detection, wherein the detection result indicates that any frame in the signal frame that needs to undergo the abnormal frame detection is a normal frame or an abnormal frame.

11. The method according to claim 10, wherein calculating the first speech quality evaluation value of the speech signal according to the detection result of the signal frame that needs to undergo the abnormal frame detection comprises:

obtaining a percentage of the abnormal frame in the speech signal; and obtaining, according to the percentage and a quality evaluation parameter, the first speech quality evaluation value corresponding to the percentage.

12. The method according to claim 10, further comprising:

after the calculating a first speech quality evaluation value of the speech signal, obtaining a second speech quality evaluation value of the speech signal by using a speech quality assessment method; and obtaining a third speech quality evaluation value according to the first speech quality evaluation value and the second speech quality evaluation value.

13. The method according to claim 12, wherein obtaining the third speech quality evaluation value according to the first speech quality evaluation value and the second speech quality evaluation value comprises subtracting the first speech quality evaluation value from the second speech quality evaluation value to obtain the third speech quality evaluation value.

14. The method according to claim 1, further comprising:

after a signal frame that is in the speech signal and that needs to undergo abnormal frame detection is detected, obtaining an anomaly detection characteristic value of the speech signal according to a detection result of the signal frame that needs to undergo the abnormal frame detection;

obtaining an assessment characteristic value of the speech signal by using a speech quality assessment method; and obtaining a fourth speech quality evaluation value according to the anomaly detection characteristic value and the assessment characteristic value by using an assessment system.

15. An apparatus comprising:

a non-transitory memory for storing computer-executable instructions; and a processor operatively coupled to the non-transitory memory, the processor being configured to execute the computer-executable instructions to:

obtain a signal frame from a speech signal, and divide the signal frame into at least two subframes;

obtain a local energy value of a subframe of the signal frame;

obtain, according to the local energy value of the subframe, a first characteristic value used to indicate a local energy trend of the signal frame; and perform singularity analysis on the signal frame to obtain a second characteristic value used to indicate a singularity characteristic of the signal frame; and determine the signal frame as an abnormal frame when the first characteristic value of the signal frame meets a first threshold and the second characteristic value of the signal frame meets a second threshold.

16. The apparatus according to claim 15, wherein, when calculating the first characteristic value, the processor is further configured to:

obtain a maximum local energy value and a minimum local energy value that are in a logarithm domain and that are in local energy values of all the subframes in the signal frame; and perform a subtraction on the maximum local energy value and the minimum local energy value that are in the logarithm domain to obtain a first difference value, wherein the first difference value is the first characteristic value.

17. The apparatus according to claim 15, wherein, when calculating the first characteristic value, the processor is further configured to:

determine target correlated subframes in a correlated signal frame prior to the signal frame in a time domain, and calculate local energy values of the target correlated subframes to obtain a minimum local energy value that is in a logarithm domain and that is in the local energy values of the target correlated subframes;

obtain a maximum local energy value that is in the logarithm domain and that is in local energy values of all the subframes of the signal frame; and perform subtraction on the maximum local energy value and the minimum local energy value that are in the logarithm domain to obtain a second difference value, wherein the second difference value is the first characteristic value.

18. The apparatus according to claim 15, wherein, when calculating the first characteristic value, the processor is further configured to:

obtain a maximum local energy value and a minimum local energy value that are in a logarithm domain and that are in local energy values of all the subframes in the signal frame;

determine target correlated subframes in a correlated signal frame prior to the signal frame in a time domain, and calculate local energy values of the target correlated subframes to obtain a minimum local energy value that is in the logarithm domain and that is in the local energy values of the target correlated subframes;

perform a subtraction on the maximum local energy value and the minimum local energy value that are in the logarithm domain and that are in the local energy values of all the subframes in the signal frame to obtain a first difference value;

perform a subtraction on the maximum local energy value that is in the logarithm domain and that is in the local energy values of all the subframes in the signal frame and the minimum local energy value that is in the logarithm domain and that is in the local energy values of the target correlated subframes to obtain a second difference value; and select, between the first difference value and the second difference value, a smaller value as the first characteristic value.

19. The apparatus according to claim 15, wherein, when calculating the second characteristic value, the processor is further configured to:

execute the computer-executable instructions to perform wavelet decomposition on the signal frame to obtain a wavelet coefficient; and obtain the second characteristic value according to a maximum local energy value and an average local energy value that are in a logarithm domain and that are in local energy values of all subframes of a reconstructed signal frame.

20. The apparatus according to claim 19, wherein, when obtaining the second characteristic value according to the maximum local energy value and the average local energy value that are in the logarithm domain and that are in the local energy values of all the subframes of the reconstructed signal frame, the processor is further configured to execute the computer-executable instructions to perform subtraction on the maximum local energy value and the average local energy value that are in the logarithm domain and that are in the local energy values of all the subframes of the reconstructed signal frame, and wherein an obtained difference value is the second characteristic value.

21. The apparatus according to claim 15, wherein, when a spacing between the signal frame and a prior abnormal frame in the speech signal is less than a third threshold and when the signal frame is an abnormal frame, the processor is further configured to execute the computer-executable instructions to adjust a normal frame between the signal frame and the prior abnormal frame to an abnormal frame.

22. The apparatus according to claim 15, wherein the processor is further configured to:

execute the computer-executable instructions to count a quantity of abnormal frames in the speech signal; and if the quantity of abnormal frames is less than a fourth threshold, adjust all abnormal frames in the speech signal to normal frames.

23. The apparatus according to claim 15, wherein the processor is further configured to:

execute the computer-executable instructions to calculate a percentage of the abnormal frame in the speech signal; and, if the percentage of the abnormal frame is greater than a fifth threshold, output speech distortion alarm information.

24. The apparatus according to claim 15, wherein the processor is further configured to execute the computer-executable instructions to calculate a first speech quality evaluation value of the speech signal according to a detection result of a signal frame that needs to undergo abnormal frame detection, and wherein the detection result indicates that any frame in the signal frame that needs to undergo the abnormal frame detection is a normal frame or an abnormal frame.

25. The apparatus according to claim 24, wherein, when calculating the first speech quality evaluation value of the speech signal, the processor is further configured to:

obtain a percentage of the abnormal frame in the speech signal; and obtain, according to the percentage and a quality evaluation parameter, the first speech quality evaluation value corresponding to the percentage.

26. The apparatus according to claim 24, wherein the processor is further configured to:

execute the computer-executable instructions to obtain a second speech quality evaluation value of the speech signal by using a speech quality assessment method; and obtain a third speech quality evaluation value according to the first speech quality evaluation value and the second speech quality evaluation value.

27. The apparatus according to claim 26, wherein, when obtaining the third speech quality evaluation value according to the first speech quality evaluation value and the second speech quality evaluation value, the processor is further configured to subtract the first speech quality evaluation value from the second speech quality evaluation value to obtain the third speech quality evaluation value.

28. The apparatus according to claim 15, wherein the processor is further configured to:

after a signal frame that is in the speech signal and that needs to undergo abnormal frame detection is detected, obtain an anomaly detection characteristic value of the speech signal according to a detection result of the signal frame that needs to undergo the abnormal frame detection;

obtain an assessment characteristic value of the speech signal by using a speech quality assessment method; and obtain a fourth speech quality evaluation value according to the anomaly detection characteristic value and the assessment characteristic value by using an assessment system.

* * * * *